US005865534A

United States Patent [19]

Hay

[11] Patent Number: 5,865,534

[45] Date of Patent: Feb. 2, 1999

[54] MATERIALS MIXER

[75] Inventor: Allan McLeod Hay, Aberdeen, United Kingdom

[73] Assignee: IDC Mixers Limited, Aberdeen, United Kingdom

[21] Appl. No.: 624,434

[22] PCT Filed: Oct. 3, 1994

[86] PCT No.: PCT/GB94/02141

§ 371 Date: Mar. 14, 1997

§ 102(e) Date: Mar. 14, 1997

[87] PCT Pub. No.: WO95/09690

PCT Pub. Date: Apr. 13, 1995

[30] Foreign Application Priority Data

Oct. 1, 1993 [GB] United Kingdom ..... 9320293
Mar. 5, 1994 [GB] United Kingdom ..... 9404273

[51] Int. Cl.[6] ..... B28C 5/16; B01F 7/26

[52] U.S. Cl. ..... 366/2; 366/65; 366/315; 366/317; 366/172.2; 366/10

[58] Field of Search ..... 366/2, 3, 9, 10, 366/13, 15, 40, 46, 65, 66, 168.1, 171.1, 172.2, 174.1, 175.2, 315, 316, 317

[56] References Cited

U.S. PATENT DOCUMENTS

| | | | |
|---|---|---|---|
| 860,031 | 7/1907 | Jones | 366/9 |
| 3,400,915 | 9/1968 | Onishi et al. . | |
| 3,414,202 | 12/1968 | Gresch . | |
| 3,717,086 | 2/1973 | Hough | 366/315 |
| 3,986,706 | 10/1976 | Giombini | 366/315 |
| 3,995,837 | 12/1976 | Parsonage et al. . | |
| 4,065,105 | 12/1977 | Lussiez et al. | 366/348 |
| 4,112,517 | 9/1978 | Giombini | 366/315 |
| 4,254,699 | 3/1981 | Skinner et al. | 366/316 |
| 4,257,710 | 3/1981 | Delcoigne et al. | 366/8 |
| 4,285,598 | 8/1981 | Horton | 366/15 |
| 4,436,458 | 3/1984 | Wisdom et al. | 366/316 |
| 4,453,832 | 6/1984 | Schumacher et al. | 366/315 |
| 4,698,378 | 10/1987 | Wehrli et al. . | |
| 4,983,046 | 1/1991 | Murata et al. | 366/317 |
| 4,995,729 | 2/1991 | Eberhardt et al. . | |
| 5,073,032 | 12/1991 | Berion et al. | 366/172.2 |
| 5,470,145 | 11/1995 | Lopez | 366/13 |

FOREIGN PATENT DOCUMENTS

| | | |
|---|---|---|
| 2427841 | 1/1980 | France . |
| 0010352 | 8/1880 | Germany . |
| 0234102 | 4/1911 | Germany . |
| 0463559 | 7/1928 | Germany . |
| 2065492 | 10/1973 | Germany . |
| 6513371 | 4/1966 | Netherlands . |
| 0615840 | 2/1980 | Switzerland . |
| 1016232 | 1/1966 | United Kingdom . |

OTHER PUBLICATIONS

International Search Report.
United Kingdom Search Report.

*Primary Examiner*—Tony G. Soohoo
*Attorney, Agent, or Firm*—Ratner & Prestia

[57] ABSTRACT

A materials mixer, suitable for mixing concrete, comprises a generally cylindrical housing (10) which houses a mixing chamber (15) consisting of an upper, dry mixing chamber portion (2), a central, wet mixing chamber portion (3) and a lower, discharge chamber portion (4). The materials mixer has an entrance (20) for materials to be mixed and an exit (25) for the complete mixture, between which are a plurality of rotating members (30, 40, 50, 60) which disrupt the flow of materials through the chamber (15) causing mixing of the materials. The shape of the mixing chamber is defined by a plurality of baffle plates (11, 12, 16) which help determine the path of the materials though the chamber.

27 Claims, 11 Drawing Sheets

MATERIALS MIXER

The present invention relates to a materials mixer and especially, but not exclusively, to a continuous materials mixer for the production of concrete Substantial quantities of concrete are frequently required for use in, for example, the building industry. Traditionally such large quantities have been produced by stationary plants, usually situated close to quarries, and the mixed concrete has then been transported, in special purpose lorries or trailers, to the site where the concrete is required.

Often concrete is required in smaller quantities and it is usual to make up such small quantities on-site using a drum type device. Drum-type devices are generally loaded manually, with the desired amounts of the various constituents of the concrete and are used to mix a batch of concrete, before removal of that batch and manual depositing of the constituents of the next batch into the drum.

Such drum-type mixers are generally capable of mixing only small batches and are therefore unsuitable for providing large amounts of mixed concrete. In addition, because the constituents are deposited manually into the drum different batches may be inconsistent in quality and constitution. Should such a mixer be required to provide a large quantity of concrete many separate batches must be made up, which would be both time consuming and labour intensive.

Provision of large quantities of concrete has therefore generally required transport of the concrete from the site where it is mixed, to the site where it is required. This requires expensive purpose-built transporters, and may be inconvenient and tine inefficient, especially if the site where the concrete is required is far from the site where the concrete is made up.

According to the present invention there is provided a materials mixer for mixing materials comprising a housing containing a mixing chamber, the housing having an upper inlet for materials to be mixed and a lower discharge outlet for mixed materials, and at least one rotatable mixing element in said mixing chamber, said at least one mixing element being positioned in the path between said inlet and said discharge outlet, to effect mixing of the materials to be mixed.

Preferably, said at least one rotatable mixing element comprises a member mounted on a rotatable shaft, and extending radially away from the axis of said shaft.

Preferably, said mixing chamber has an upper dry mixing chamber portion for the mixing of a plurality of substantially dry materials, a central, wet mixing chamber portion for the mixing of at least one fluid with a mixture of substantially dry materials, and a lower discharge chamber portion for controlling the motion of mixed materials towards the discharge outlet.

Preferably, there is provided at least one rotatable mixing element comprising a dry mixing disc provided in said dry mixing chamber portion, and at least one rotatable mixing element comprising a wet mixing disc in said wet mixing chamber portion.

Preferably, the boundary between the dry mixing chamber portion and the wet mixing chamber portion is defined by a subsequent rotatable mixing element comprising a dry mixing disc.

Preferably, there is provided at least one rotatable element in said discharge chamber portion, said at least one rotatable element comprising a discharge member.

Preferably, said discharge member is coupled to said rotating shaft so as to allow it to rotate with lower angular velocity than said rotating shaft.

Preferably, said discharge member includes a substantially helical member located upon an upper surface of said discharge member.

Preferably the wall of said dry mixing chamber portion comprises a dry mix baffle plate which is configured so as to control the movement of materials from the dry mixing chamber portion to the wet mixing chamber portion.

Preferably, the wall of said wet mixing chamber portion comprises a wet mix baffle plate which is configured so as to control the movement of materials from the wet mixing chamber portion to the discharge chamber portion.

Preferably, said wet mix baffle plate provides an inclined surface having an annular upwardly projecting member extending therefrom.

Preferably, the wall of the discharge chamber portion comprises a discharge baffle plate which is configured so as to control the movement of materials in the discharge chamber portion towards the discharge outlet.

The surface of at least one of the mixing discs may be provided with irregularities, apertures or projections in order to further disrupt the flow of material.

Preferably, there is provided a fluid inlet to said wet mixing chamber portion for said fluid, said inlet allowing fluid to enter said wet mixing chamber portion without having passed through said dry mixing chamber portion.

Preferably, said fluid inlet comprises an axial bore in said rotating shaft and a nozzle means allowing said fluid to flow out of said axial bore into said wet mixing chamber portion.

Preferably, the housing is generally cylindrical.

Preferably, the housing is divided axially into a plurality of sections which may be separated from each other in order to allow access to the inside of the mixing chamber.

Preferably, the housing comprises two sections each of which is hinged to a point fixed with respect to the mixer as a whole.

Preferably, the mixer includes at least one material feed means to transport at least one of the materials to be mixed towards the mixing chamber.

Preferably, the material feed means comprises a channel in which there is provided a first forcing means.

Preferably, the material feed means includes an exit means whereby transported material can exit the channel, said exit means being at or adjacent one end of the first forcing means and said material feed means also includes a second forcing means applying a force in substantially the opposite direction to that applied by the first forcing means, said exit means being positioned between the first forcing means and the second forcing means.

Preferably, the forcing means comprise rotatable screw or auger members.

Preferably, there is provided sensing and/or control means to sense and/or control the rate of feed of at least one of the materials to be mixed.

Preferably, there is provided a second control means which may be set to operate a single material feed means for any one of the materials to be mixed for a predetermined time, facilitating calibration of the transport means.

Preferably, at the entrance to the materials feed means, there is provided an anti-bridging means to prevent the material from bridging across the entrance to the channel.

Preferably, the anti-bridging means comprises at least one oscillating flap adjacent the entrance to the channel.

Preferably, the mixer is designed or adapted for the mixing of concrete or similar materials.

Embodiments of the present invention will now be described, by way of example, with reference to the accompanying drawings in which:

DETAILED DESCRIPTION

Figure 1:
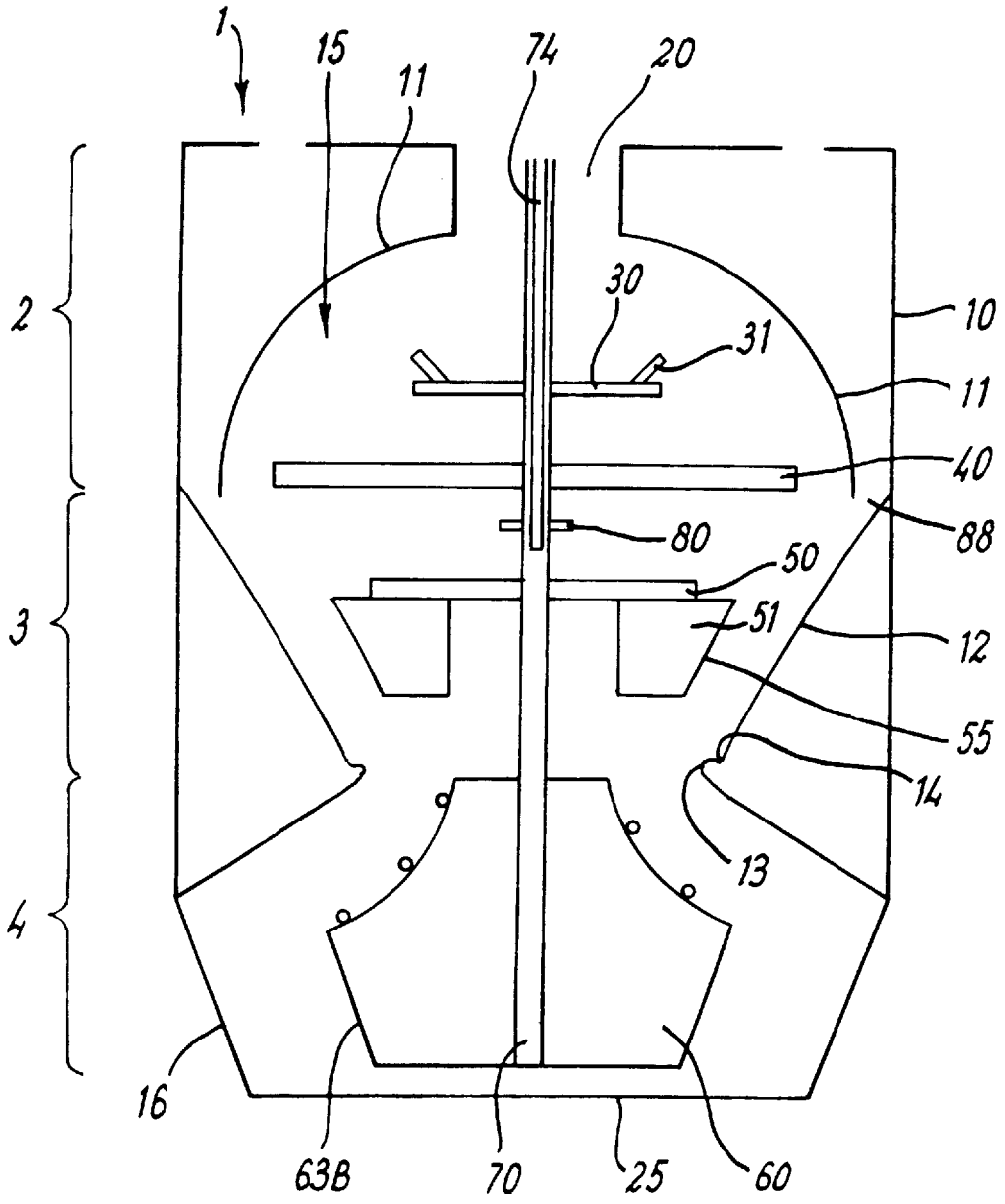
FIG. 1 is a schematic vertical partial cross sectional view of an embodiment of a materials mixer in accordance with the present invention.

Referring to the accompanying drawings, an embodiment of a materials mixer 1 according to the present invention comprises a generally cylindrical housing 10 containing a mixing chamber, generally designated 15, divided into an upper dry mixing chamber 2, a central, wet mixing chamber 3 and a lower, discharge chamber 4. The shape of the dry mixing chamber 2 is defined by a fixed dry mix baffle plate 11, the shape of the wet mixing chamber 3 is defined by a fixed wet nix baffle plate 12, and the shape of the fixed discharge chamber 4 by a fixed discharge baffle plate 16. The dry and wet mix baffle plates 11 and 12, ate attached to the inside of the housing 10 and form the walls of the dry mixing chamber 2 and wet mixing chamber 3, respectively. The discharge baffle plate 16 is formed from the interior surface of the housing 10 and forms the wall of the discharge chamber 4. The baffle plates 11, 12, 16 are made from a suitable material such as steel or rubber.

Extending vertically through the centres of all three chambers 2, 3, 4 is an axle 70 which may be driven to rotate by a motor (not shown). Mounted upon the axle 70, vertically spaced apart, are first 30 and second 40 dry mixing discs, a wet mixing disc 50 and a discharge member 60. The first dry mixing disc 30 is located in the dry mixing chamber 2. The second dry mixing disc 40 defines the boundary between the dry mixing chamber 2 and the wet mixing chamber 3. The wet mixing disc 50 is located in the wet mixing chamber 3. The discharge member 60 is located in the discharge chamber 4.

The housing 10 defines a first entrance 20 through which at least one of a plurality of materials to be mixed may enter the dry mixing chamber 2, and an exit 25, though which a mixture of materials may exit from the discharge chamber 4.

The mixing discs 30, 40, 50, and discharge member 60 affect the flow, through the chambers 2, 3, 4, of materials to be mixed, thus causing them to be thoroughly mixed before they leave the discharge chamber 4 via the exit 25.

Typically, in the mixing of, for example, concrete, particulate materials such as cement, sand and aggregate are mixed with a fluid, normally water, which may include additives In the embodiment of FIG. 1 the particulate materials are fed into the dry mixing chamber 2, via the first entrance means 20. The fluid is added via a bore 74 provided in the axle 70, and dispensed into the chamber 15 via nozzles 80, and additionally fluid may be added through the housing 10 and fed by gravity into the wet mixing chamber 3, for example via an annular outlet 88 just beneath the dry mix baffle plate 11. The annular outlet 88 also prevents fluid which may be forced up the wet mix baffle plate 12, from being forced onto the dry mix baffle plate 11 and thus entering the dry mixing chamber 2.

Thus in use, substantially dry particulates, (cement, sand and aggregate) are fed into the dry mixing chamber 2, through the entrance 20 and impact the first dry mixing disc 30. The centrifugal force exerted by the disc 30 in conjunction with the configuration of the disc 30 causes the particulates to be mixed together and projected upwards and away from the centre of the dry mixing chamber 2.

The shaped dry mix baffle plate 11 directs the particulates towards the second dry mixing disc 40, which disrupts the flow and enhances mixing. At this stage the particulates are still substantially dry but are well mixed.

The existence of some moisture, which is frequently present in sand or aggregate, enhances the mixing of the cement with these materials. Below the second dry mixing disc 40, nozzles 80 are provided on the axle 70 which dispense water into the wet mix chamber 3. The water mixes with the dry mixture of particulates and this mixing is enhanced by the action of the wet mixing disc 50. This disc 50 is provided with a number of downwardly extending fins 51, 52, 53 to further enhance mixing.

The shape of the wet mixing chamber 3 is defined by the wet mix baffle plate 12 so as to direct the now wet mix towards the axial centre of the wet mix chamber 3. The wet mix baffle plate 12 is provided with a liquid retention ring 13 which provides a recess 14 to retain any substantially unmixed water. Any such water is then absorbed into the wet mixture.

The now wet mixture then falls towards the discharge member 60 which is provided in the discharge chamber 4 and which may rotate at a lower speed than the other rotating members 30, 40, 50, and the discharge baffle plate 16 is configured, inclined at about 20 degrees to the vertical, to direct the mix towards the exit 25 at an appropriate speed.

The mix then falls via the exit 25 leaving the discharge chamber 4, as concrete, ready for use. When operating normally the same total amount of material leaves each chamber in a given period as is fed into the chamber in the same period. Thus the mixer can be operated continuously and is able to mix a large quantity of concrete. Furthermore since the feeding of the materials into the chamber may be automatically regulated, the quality of the concrete produced will be consistent.

In order to provide a good mix and to regulate the speed of flow of materials through the mixer in order to prevent clogging and enhance effective mixing the configurations of the baffle plates 11, 12, 16 and the mixing discs 30, 40, 50 and discharge member 60 are important, and these elements will now be described in more detail.

Figure 2A:
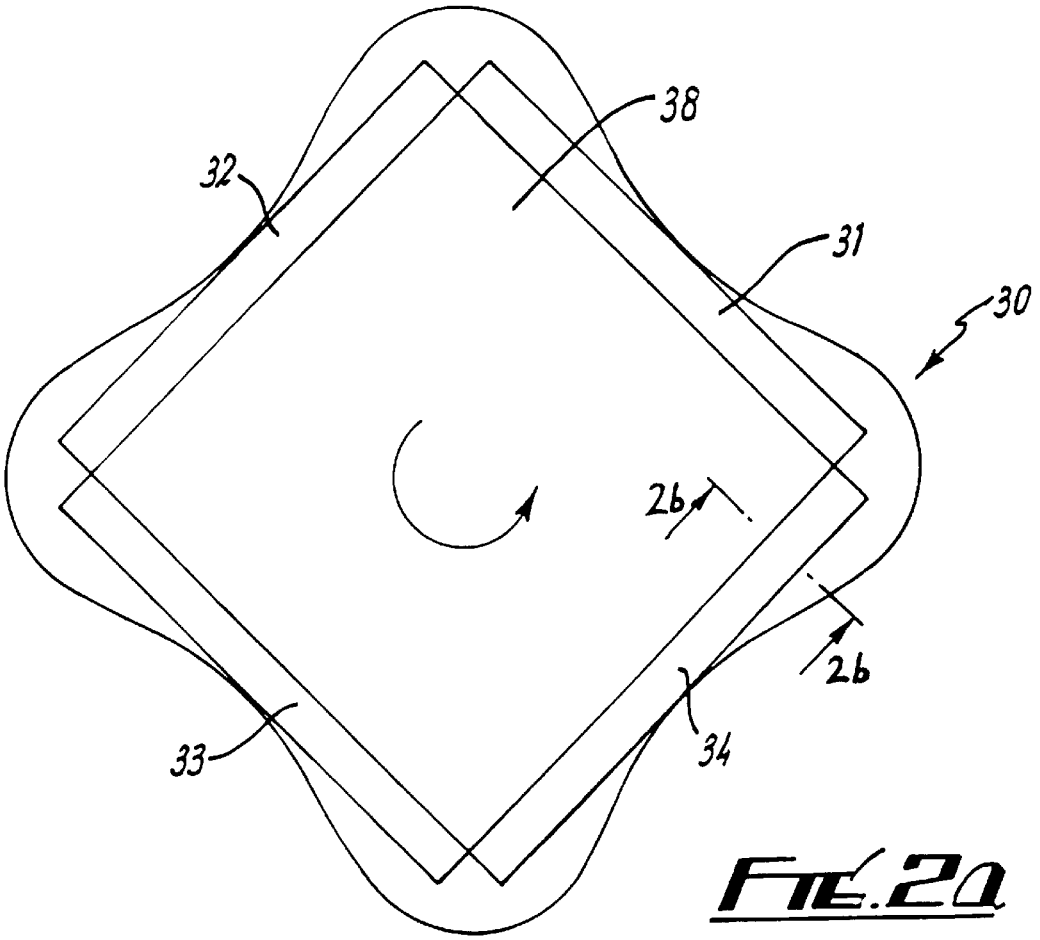
FIGS. 2*a*, 2*b* and 2*c* show views of a first element of the mixer of FIG. 1.
Figure 2B:
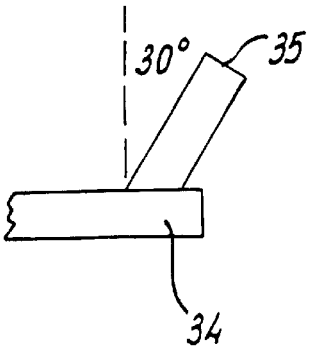
Figure 2C:
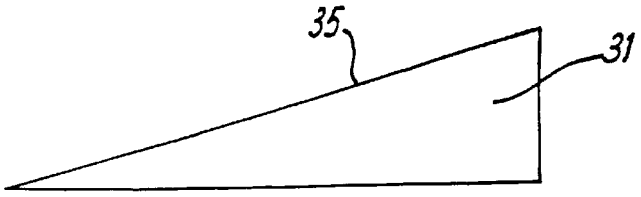

The first dry mixing disc 30 is illustrated in FIG. 2*a* which is a plan view, 2*b* which is a cross sectional view taken along 2*b*—2*b*, and 2*c* which is a cross sectional view of an element 31 of the disc 30. The disc 30 provides an essentially flat surface 38, on which are mounted four elongate agitators 31, 32, 33, 34. Each agitator comprises an upper surface 35, which at one end of the agitator is level with the surface 38 of the disc 30, but which is inclined along the length of the agitator so that it rises progressively above the surface 38 of the disc 30, the agitator thus having a substantially triangular form, as is shown in FIG. 2*c* which is a cross sectional view of the agitator 31. The agitators are positioned such that when the disc 30 rotates the higher ends of the agitators 31, 32, 33, 34 lead. This arrangement helps avoid wear of the disc and agitators 31, 32, 33, 34. The agitators do not extend vertically from the surface 38 of the disc 30 but are inclined away from the centre of the disc 30 at an angle of about 30 degrees from the vertical as illustrated in FIG. 2*c*. This configuration ensures that the particulate matter descending onto the first dry mixing disc 30 is projected upwardly and away from the centre of the dry mixing chamber 2 and has also been found to avoid undue wear on the disc 30 and agitators 31, 32, 33, 34.

Figure 3:
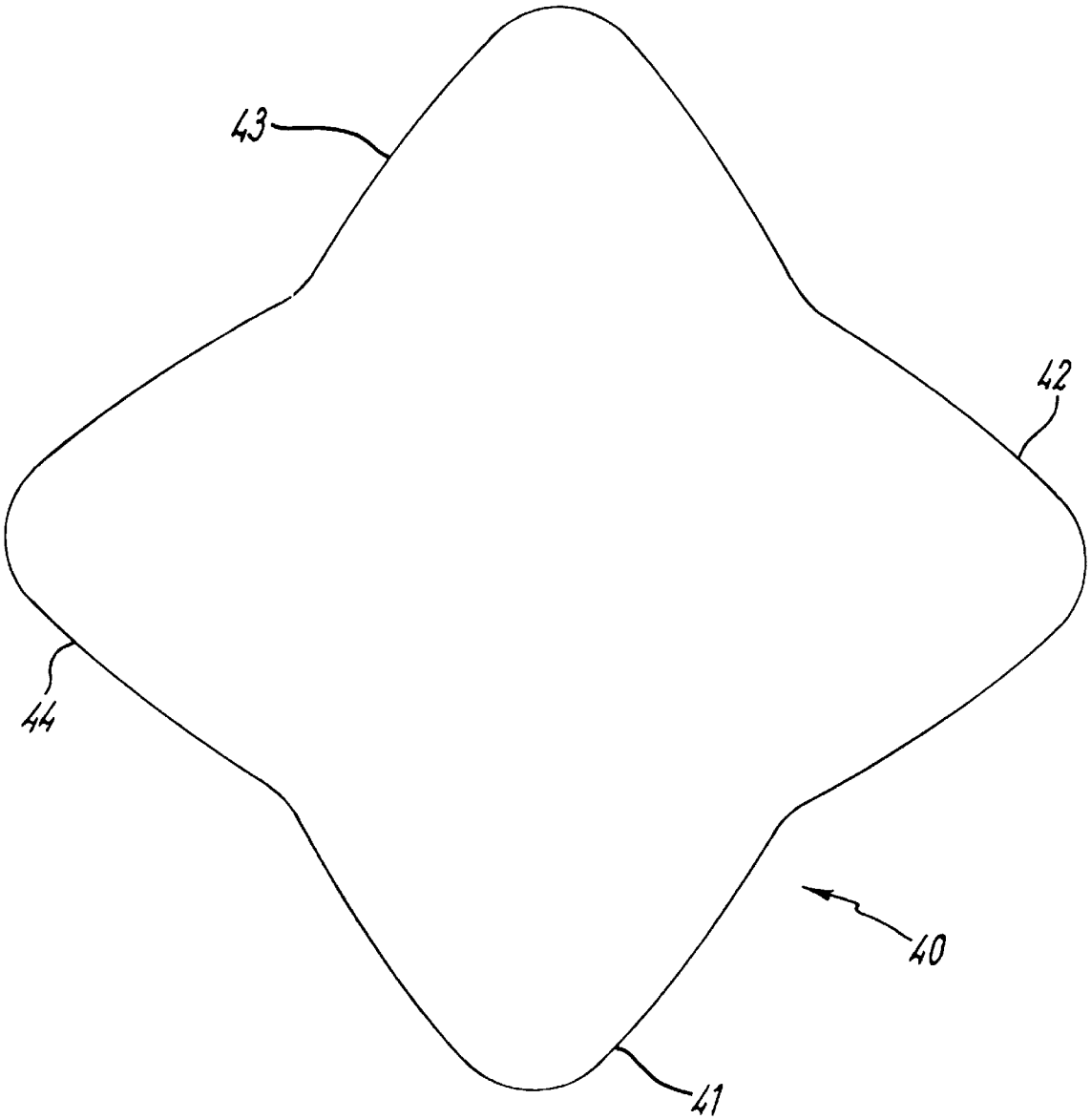
FIG. 3 shows a plan view of a second element of the mixer of FIG. 1.

A preferred shape of second dry mixing disc 40 is illustrated in FIG. 3. This disc 40 is of open form, having four portions 41, 42, 43, 44 which 'chop' the flow of materials through the dry mixing chamber 2, enhancing mixing. It should be appreciated that use of the word disc is not intended to it the description of the configurations to a substantially circular form.

Figure 4:
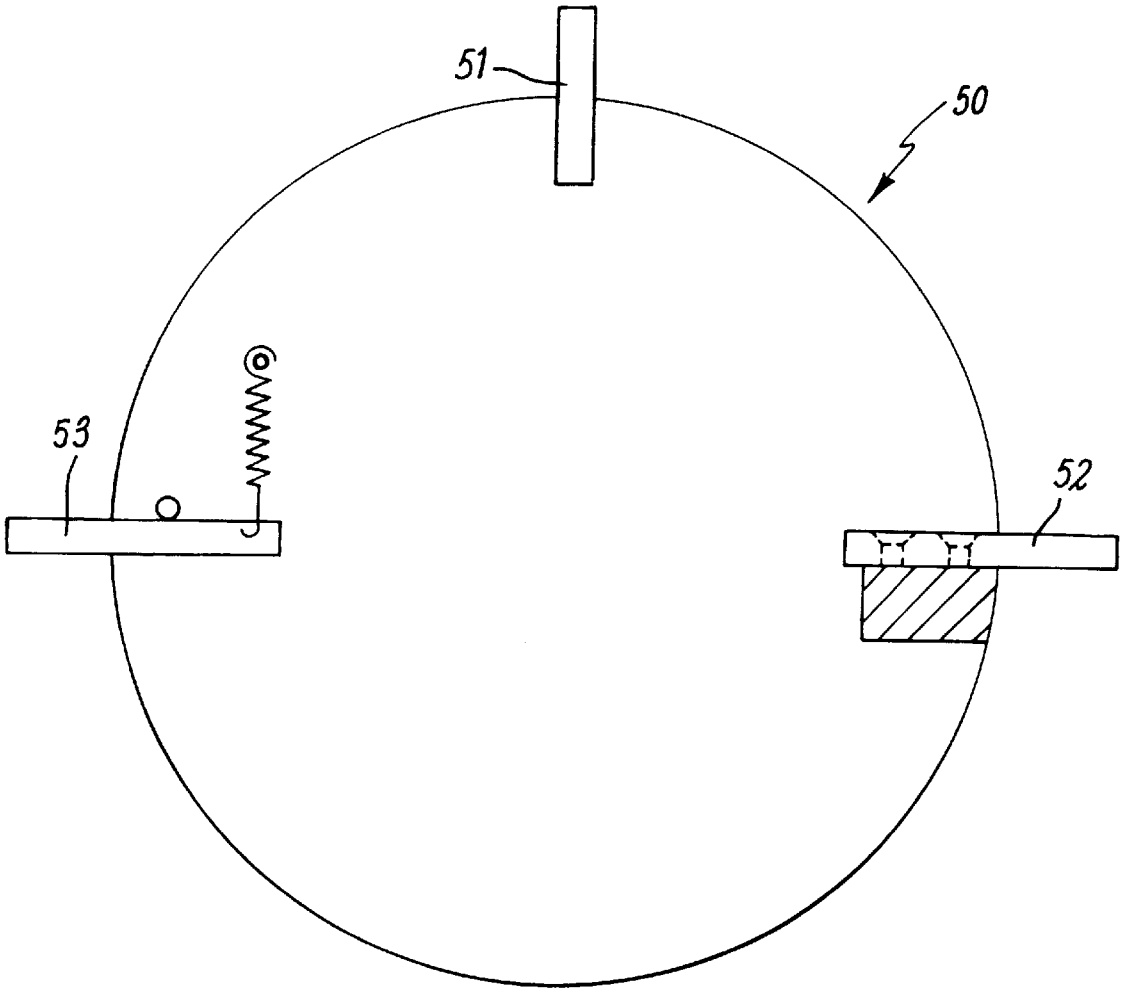
FIG. 4 shows schematically a third element of the mixer of FIG. 1 and illustrates alternative designs.

The wet mixing disc 50 is illustrated in plan view in FIG. 4. This disc 40 comprises a flat substantially circular surface which is provided with a plurality of downwardly projecting fins (as illustrated in FIG. 1). The fins 51, 52, 53 may be of any of three envisaged types. Firstly, they may be formed integrally 51 as part of the disc 50. Secondly they may be of a replaceable type 52 which can be attached and detached from the disc 50 in order to allow replacement, or insertion of a different size of fin. Thirdly, they may be pivotally attached 53 to the disc 50 with a resilient restoring means tending to restore each fin 53 to its normal working position, thus providing additional resilience to impact from large particles of aggregate, thus reducing wear and impact damage.

The outermost edge 55 of the fin is, in use, spaced apart from the adjacent surface of the wet mix baffle plate 12 and the smallest distance between the fin edge 55 and baffle plate 12 should be equivalent to the diameter of the largest particles in the chamber plus about 5–10 mm. It is preferable that the edge 55 of the fin 51 is not parallel to the surface of the baffle plate 12 but is inclined by about 10 degrees, with respect to the baffle plate 12. Thus, the distance between the edge 55 of the fin 51 and the closest point of the wet mix baffle plate 12, will vary along the length of the edge 55. The number of fins 51, 52, 53 provided on the disc 50 is normally two or four but may be varied according to the characteristics of the concrete constituents. In particular the finer the aggregate the greater the number of fins required for efficient mixing.

Figure 5A:
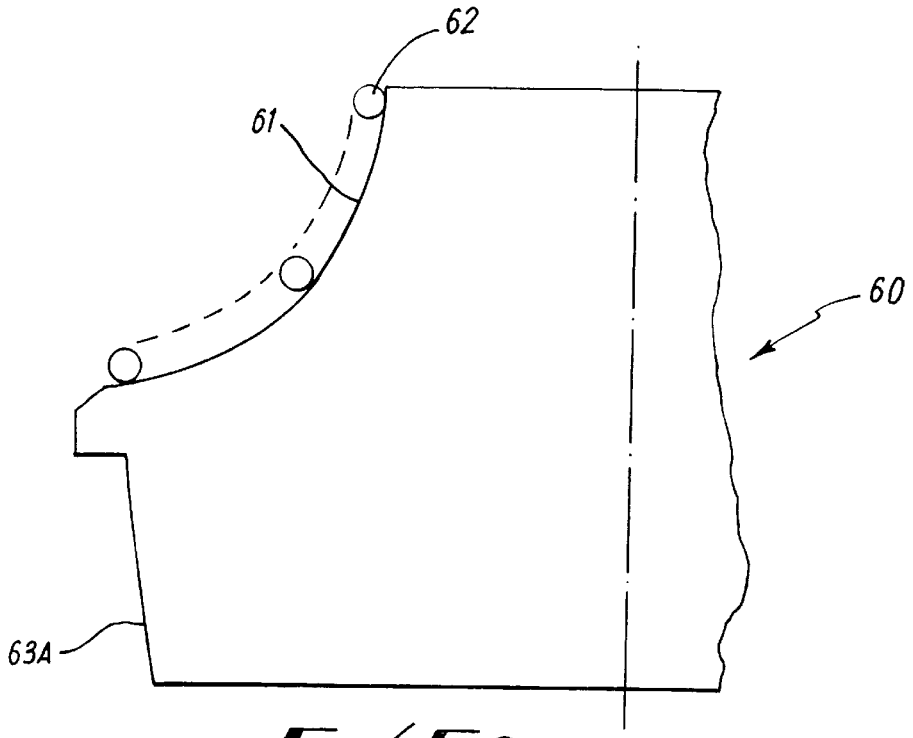
FIG. 5*a* shows a cross sectional view of a fourth element the mixer of FIG. 1.
Figure 5B:
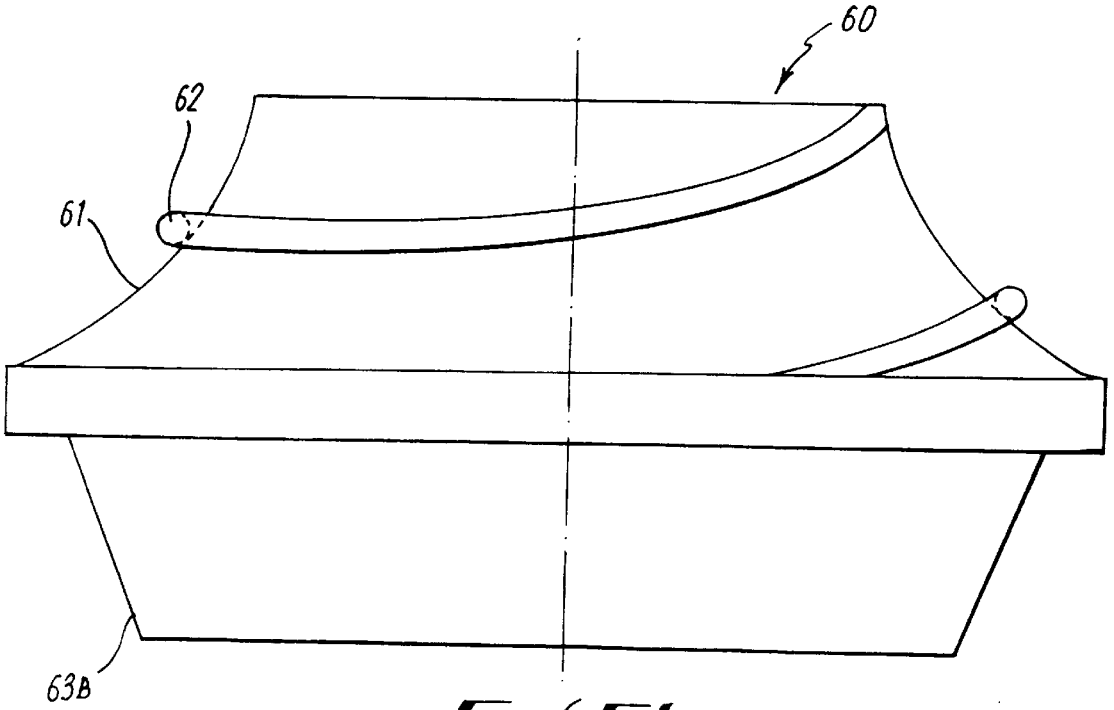
FIG. 5*b* shows a side view of an alternative design for the fourth element.

The discharge member 60 is illustrated, showing alternative designs, in FIGS. 5*a* and 5*b*. The member 60 includes a curved upper surface 61 to which is attached a substantially helically shaped elongate member 62. The discharge member 60 further includes a side surface 63*a*, 63*b* which may be a substantially vertical surface 63*a* or may be a surface 63*b* substantially parallel to the discharge baffle plate 16. Choice of the appropriate angle of the side surface 63*a*, 63*b* depends on the characteristics of the mix.

Figure 6:
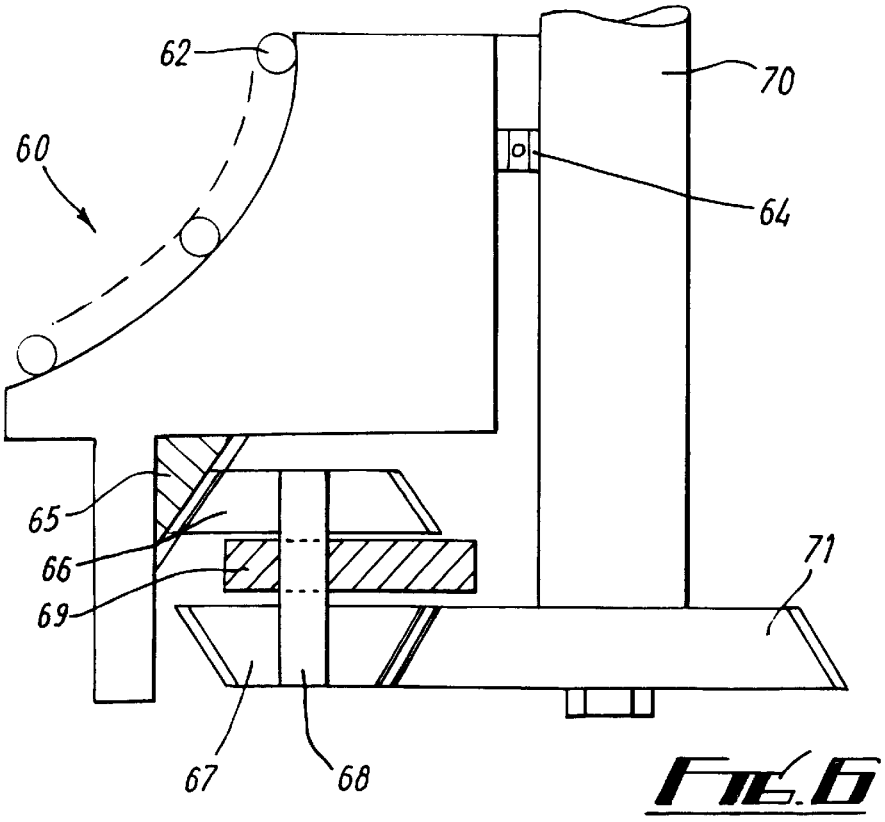
FIG. 6 shows a cross section of a preferred embodiment of the element of FIGS. 5*a* and 5*b*.

FIG. 6 illustrates a variation of the discharge member 60 which is constructed so as to allow the discharge member 60 to rotate at a slower speed that the axle 70 and the mixing discs 30, 40, 50. The purpose of this is to reduce tithe speed at which concrete is ejected from the discharge chamber 4 and thus enhance mixing and prevent separation of the constituents of the mixed concrete and reduce spattering of the concrete ejecting from the discharge chamber 4.

In this variation the discharge member 60 is connected to the axle 70 by a centralising bearing 64 and is also coupled to a gear pinion 71 attached to the bottom of the axle 70, via a gearing insert 65 and a gear train comprising a pair of idler gears 66, 67 connected by an idler spindle 68 and retained by an idler retaining ring 69. Preferably there would be provided three such idler gear trains spaced equidistantly about the gear pinion 71. A degree of slip may be built into the gearing system so that load applied by the wet mix, to the discharge member 60, has a braking effect upon the discharge member 60, reducing its speed of rotation. Typically the rotational speed of the axle 70 and mixing discs 30, 40, 50 might be about 300 revolutions per minute, and a suitable speed for the discharge member 60 about 100 revolutions per minute.

Figure 7:
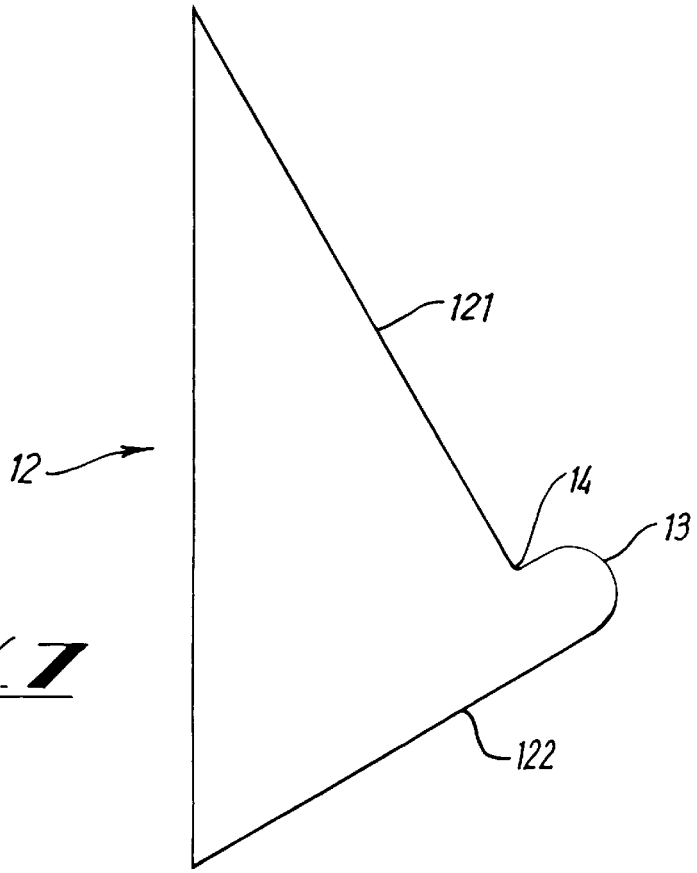
FIG. 7 shows a cross sectional view of a further element of FIG. 1.

As illustrated in the cross sectional view of FIG. 7 the wet mix baffle plate 12 is provided with a first surface 121 inclined at about 30 degrees to the vertical, which is a suitable angle for facilitating flow of wet mix through the wet mixing chamber 3 at a suitable speed, and is shaped to form a liquid retention ring 13 providing a recess 14. The wet mix baffle plate 12 also includes a lower surface 122 which is suitably inclined, being approximately at right angles to the upper surface 121.

Figure 8:
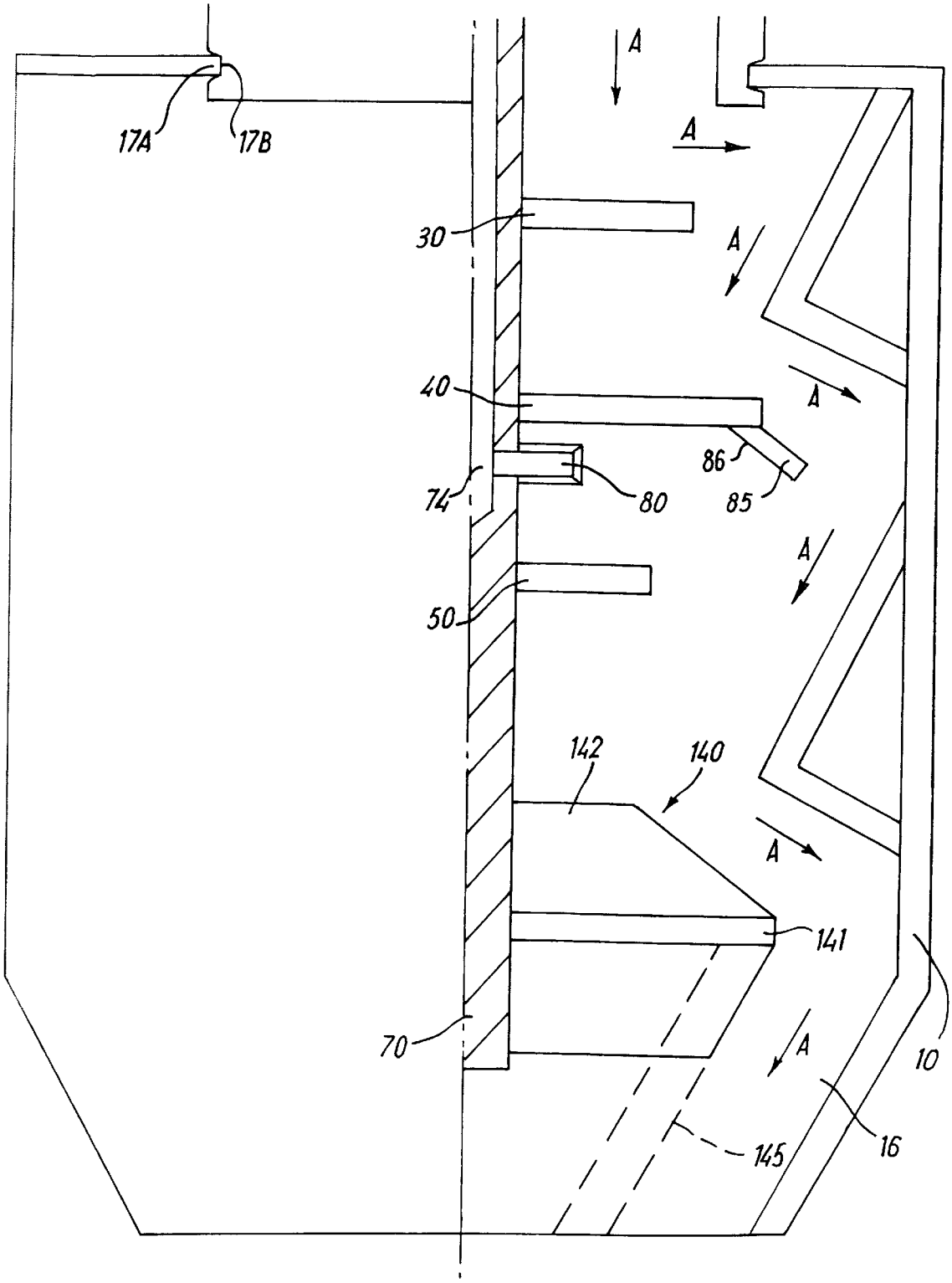
FIG. 8 shows a vertical partial cross sectional view of an alternative embodiment of a materials mixer according to the present invention to that illustrated in FIG. 1.

FIG. 8 illustrates an alternative embodiment of a mixer according to the present invention. The design is broadly the same as that of the embodiment illustrated in FIG. 1 although there are variations in the configurations of the rotating members and baffle plates, which are evident from the drawings and will not be described in detail. Elements similar to those illustrated in FIG. 1 have been designated with the same reference numerals.

In the embodiment of FIG. 8 a water deflection member 85 is attached to the bottom surface of the second dry mixing disc 40. The deflection member 85 comprises a continuous annular member with an inclined surface 86 adapted to deflect water downwards thus preventing a substantial amount of water from rising above the level of the second dry mixing disc 40, into the dry mixing chamber 2. Such a deflection member could also be employed in the embodiment of FIG. 1.

Figure 9A:
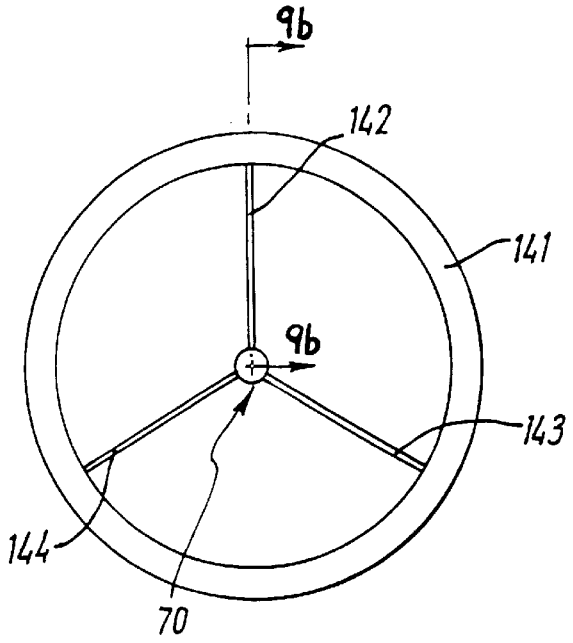
FIGS. 9*a*, 9*b* and 9*c* show plan, cross sectional and side views of an element of the materials mixer of FIG. 8.
Figure 9B:
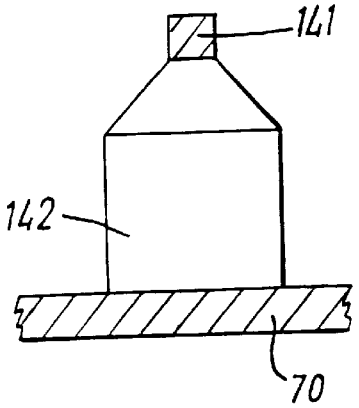

The discharge member (designated 140 in FIG. 8) is of different configuration to the corresponding member 60 illustrated in FIG.S 1, 5*a*, 5*b* and 6. FIG.S 9*a*, 9*b*, and 9*c* illustrate this member 140 in greater detail, FIG. 9*a* being a plan view, FIG. 9*b* being a cross a sectional view taken along 9*b*—9*b*, and FIG. 9*c* being a side view including an optional helical member 145, and a support member 146 for the helical member 145.

Figure 9C:
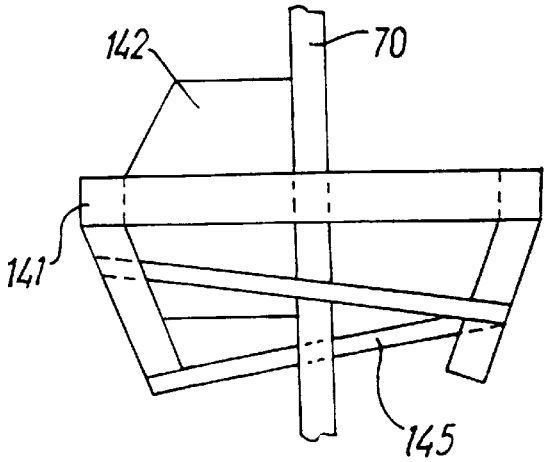

The discharge member 140 comprises an outer ring 141, through which mixed concrete may fall, coupled to the axle 70 by three vertical planar members 142, 143, 144. FIG. 8 and 9*c* illustrate that in addition to an outer ring 141, there may be a vertically extending generally helical member 145 (the general path of which is illustrated by the broken lines in FIG. 8), the diameter of which decreases, as it extends downward, at an angle approximately corresponding to the angle of the discharge baffle plate 16. A further variation (not shown) provides the helical member 145 without the vertical planar members 142, 143, 144, but being attached to the axle 70 by cylindrical rods (not shown).

Figure 10:
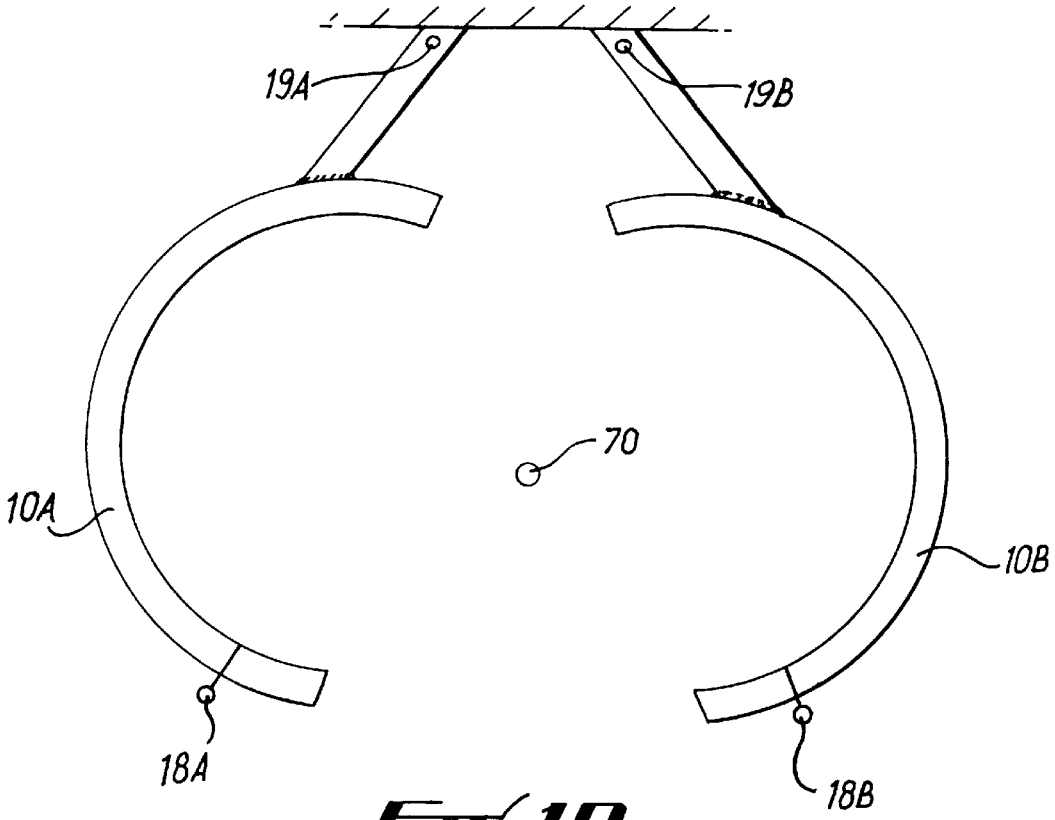
FIG. 10 is a schematic horizontal cross section of the outer housing of an embodiment of a mixer according to the present invention.

FIG. 10 is a horizontal cross sectional view illustrating schematically a configuration for providing the housing 10 in two parts 10A, 10B each being pivotable, about its respective hinge 19A, 19B, away from the axle 70. For convenience the baffle plates and rotating members are not shown in FIG. 10. The two parts 10A and 10B, shown separated, may be looked together by a two-part catch mechanism 18A, 18B. When closed, a top part 17 of the housing 10 fits into a location groove 17B provided for the purpose, as shown in FIG. 8.

Figure 11:
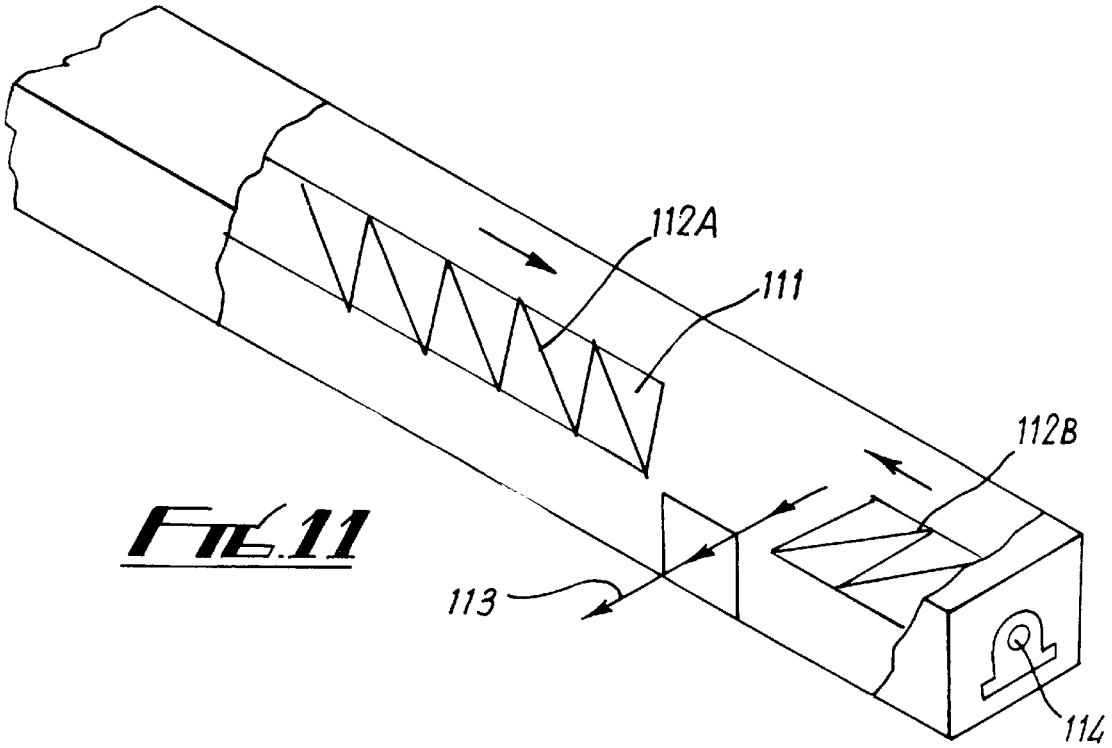
FIG. 11 shows schematically part of a material feed means which may be incorporated in embodiments of the present invention.

FIG. 11 illustrates an embodiment of a feed mechanism, for automatic feeding of a particulate material towards the entrance 20 to the dry mixing chamber 2. Material is fed along a feed channel 111 by virtue of a rotating auger member 112A, 112A, journalled in a bearing 114, having a large screw thread which moves the particulate material by rotation of said auger member 112A, 112B, working on a similar principle to that of the Archimedean screw. In this way the particulate material is moved to an exit 113 from which the material may fall or be transported into the dry mixing chamber 2. In order to prevent clogging, portions of the auger member, 112A, 112B respectively, extending on different sites of the exit 113, are provided with differently handed threads. Thus, rotation of the auger member 112A, 112B in a single direction, moves the material towards the exit 113, from both sides of the exit.

Such a feed mechanism is appropriate for inclusion in an embodiment of the present invention since the amount of material fed per unit tine can be adjusted by adjustment of the speed of rotation of the auger member 112A, 112B (the dimension and configuration of the channel 11 and member 112 remaining constant). Providing an adjustable continuous feed mechanism for each of the materials to be mixed, including the fluid, enables continuous mixing to be performed, and allows for consistent quality of the mix produced as well as allowing adjustment of the rate of feed of any given material without interrupting the mixing process.

Figure 12:
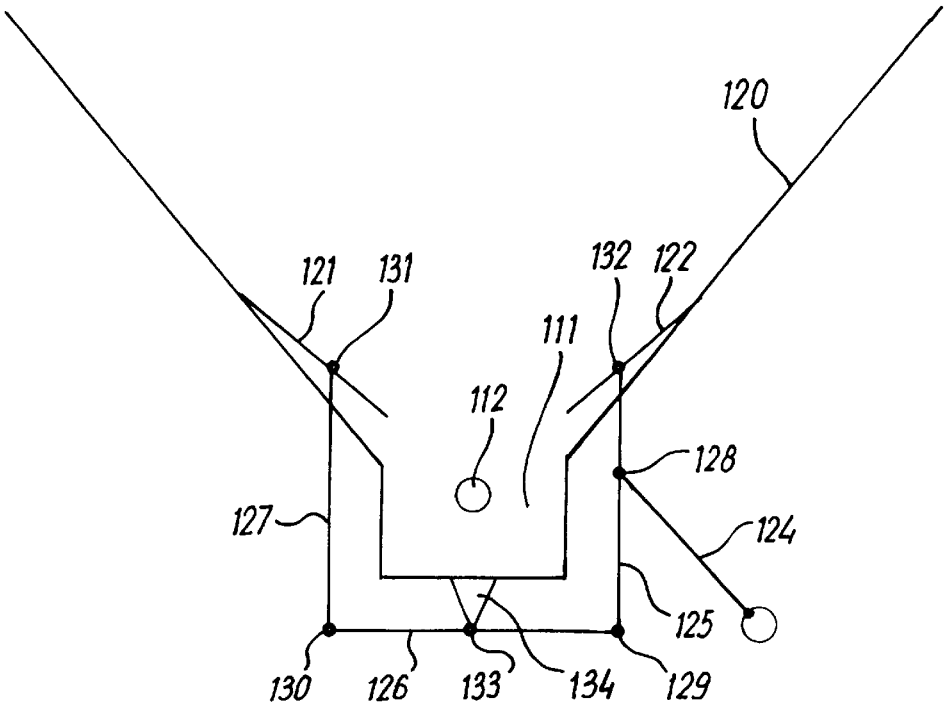
FIG. 12 illustrates an additional element of a material feed means.

FIG. 12 illustrates in cross section means to facilitate entrance of a particulate material from a hopper 120 into the feed channel 111. In order to prevent 'bridging' of the material over the channel 111, and a consequent drop in the amount of material entering the channel 111, a pair of agitator board 121, 122 are provided adjacent the channel 111. The agitator boards are driven by rotation of an eccentric shaft 123, via connecting rods 124, 125, 126, 127 which are connected by first pivots 128, 129, 130 to each other, by second pivots 131, 132 to the agitator boards, and by a third pivot 133 to a member 134, fixed with respect to the hopper 120 and channel 111. Thus, the agitator 121, 122 boards are driven alternately up and down, preventing bridging and helping to regulate is the amount of material entering the channel 111, and subsequently, the dry mixing chamber 2. Use of a low friction material as the inner surface of the hoper also helps regulate the material feed and prevent clogging.

An embodiment of the present invention would therefore include hoppers for each of the particulate materials, having anti-bridging means as previously described, and feeding mechanisms, as described, for conveying particulate material from the hoppers to the mixing chamber 15. The anti-bridging means and feeding mechanisms are preferably mechanically, rather than manually, operated, and a controls could be provided in order to control the rate of flow of each material to be mixed. The controls may include an option to run a single material feed for a predetermined period, facilitating calibration of the material feed.

Figure 13:
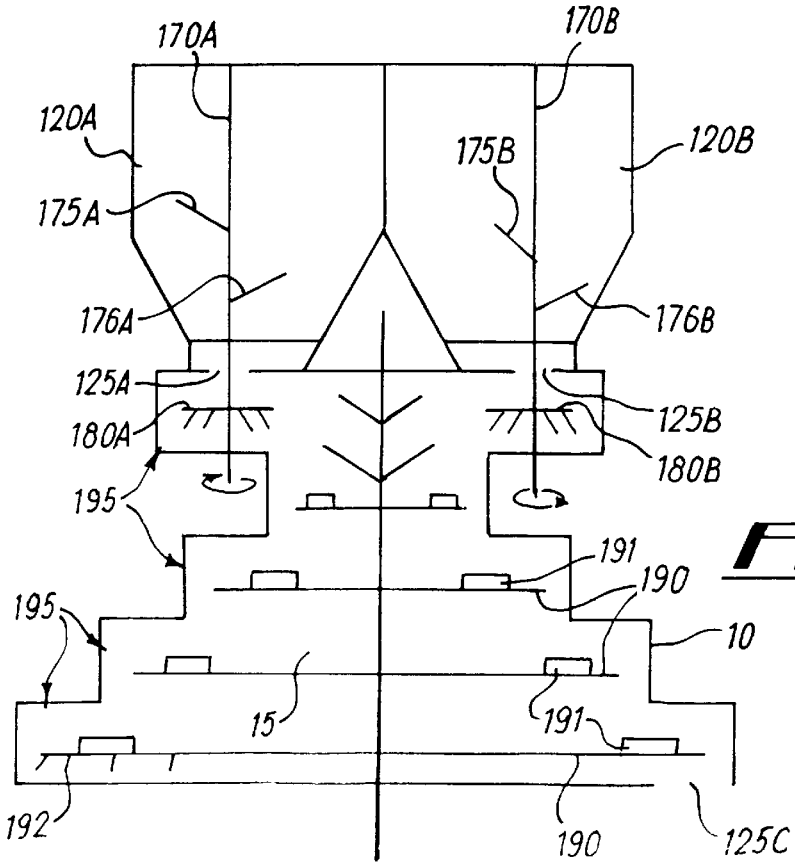
FIG. 13 illustrates schematically a further alternative embodiment of a mixer in accordance with the present invention.
Figure 14A:
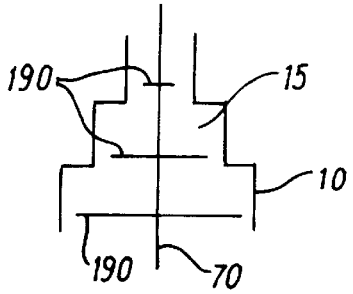
FIGS. 14*a* to 14*h* show schematically various alternative embodiments of elements of mixers in accordance with the present invention.
Figure 14B:
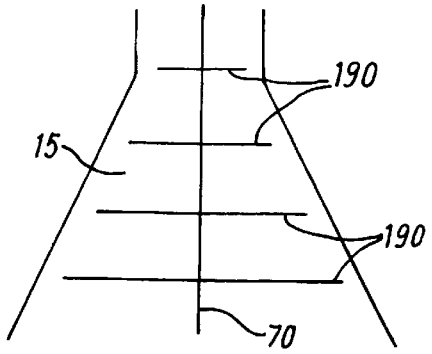
Figure 14C:
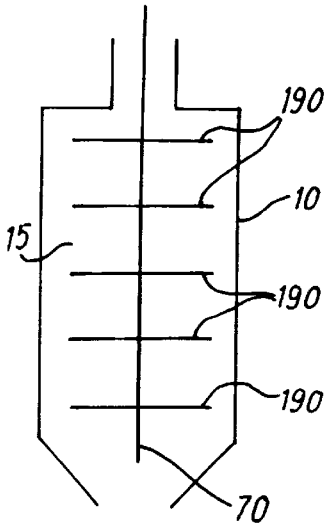
Figure 14D:
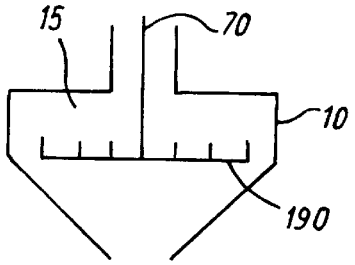
Figure 14E:
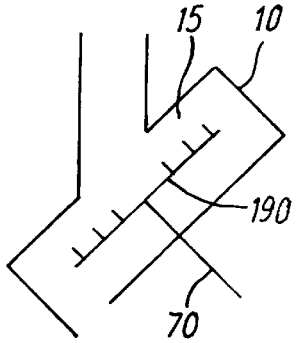
Figure 14F:
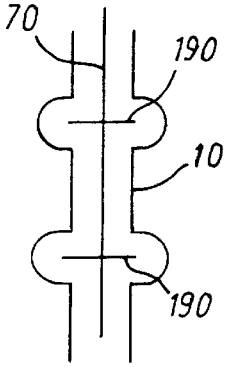
Figure 14G:
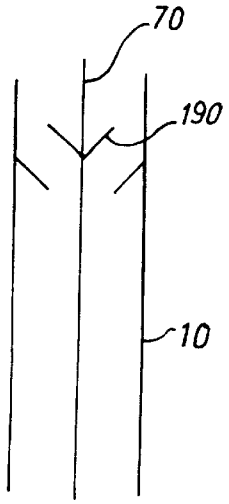
Figure 14H:
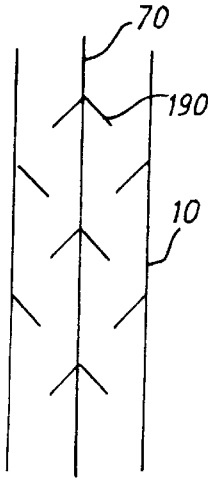

FIG. 13 shows an alternative embodiment of a mixer according to the present invention. As illustrated, the mixer comprises apparatus including two storage hoppers 120A, 120B for particulate matter, each of which terminates at its lower extreme at a regulatable opening 125A, 125B allowing material to fall towards the mixing chamber 15. Through each storage hopper 120A, 120B runs a vertical rotating shaft 170A, 170B upon which are mounted a plurality of agitators 175A, 175B, 176A, 176B which agitate the materials in the hoppers 120A, 120B preventing bridging and clogging.

Mounted on the shafts 170A, 170B are rotating members, for example discs 180A, 180B which have downwardly extending projections 185A, 185B, and which propel the materials towards a rotating axle 70 which runs vertically through the centre of a mixing chamber 15.

The mixing chamber 15 includes various rotating members generally designated 190, some of which include agitators 191 on their surfaces, and/or agitators protruding downwardly 192, which in combination with the shape of the housing 10, determine the path of the materials through the mixing chamber 15 and provide thorough mixing of the constituents. Fluid is injected into the mixing chamber 15 from a plurality of nozzles 195 provided in the housing. An exit means 125C is provided towards the bottom of them mixing chamber in order to allow the mixture produced to exit from the chamber.

FIGS. 14*a* to 14*h* are schematic illustrations of examples of possible configurations of rotating members and mixing chamber shapes. Throughout FIGS. 14*a* to 14*h* the housing, which defines the shape of the mixing chamber 15 is designated 10, the axle is designated 70 and the rotating members are designated 190. Many other configurations could be designed, including for example, the provision of members including apertures grooves, spikes, blades or other vertical or inclined projections from their upper and/or lower surfaces, or an embodiment with no central axle but in which baffle plates forming the interior wall of the mixing chamber rotate and in which the rotating members are attached to the baffle plates.

Thus, the present invention, and in particular the preferred embodiment as illustrated in FIG. 1, provides a materials mixer capable of continuously mixing, for example, concrete, thus avoiding the need for many small batches of mix to be produced, and also avoiding the need for transportation of large loads of mixed concrete from stationary, remotely located mixing stations. A prototype mixer with a chamber size of approximately 30 cm diameter and 40 cm axial length has been continuously operated so as to produce a minimum of 12 tons of good quality concrete per hour.

Improvements and modifications may be incorporated without departing from the scope of the invention.

I claim:

1. A concrete mixer comprising a housing containing a mixing chamber, the housing having an upper inlet for materials to be mixed, and a lower discharge outlet for mixed concrete, said chamber having an upper dry mixing chamber portion for the mixing of a plurality of substantially dry constituents of concrete, and a wet mixing chamber portion, lower than said dry mixing chamber portion, for the mixing of at least one fluid with the mixture of substantially dry constituents of concrete and said mixer including in said mixing chamber at least three rotatable mixing elements positioned in the path between said inlet and said discharge outlet to effect mixing of the materials to be mixed, wherein said rotatable mixing elements each comprise a member mounted upon a rotatable shaft and extending radially away from the axis of said shaft, said members comprising an upper member mounted on said shaft nearest said upper inlet, a lower member mounted on said shaft nearest said lower discharge outlet and at least one further member mounted on said shaft between said upper and said lower members, said upper member and said at least one further member each comprising a dry mixing disc for the mixing of said substantially dry constituents of concrete, and said lower member comprising a wet mixing disc for the mixing of said substantially dry constituents of concrete with said at least one fluid, wherein the boundary between the dry mixing chamber portion and the wet mixing chamber portion is defined by said further dry mixing disc.

2. A concrete mixer as claimed in claim 1, wherein a wall of said wet mixing chamber portion comprises an inclined surface extending downwardly and inwardly towards said rotatable shaft, defining an exit aperture of said wet mixing chamber portion located below said wet mixing disc, and having an annular projection extending around said exit aperture and projecting inwardly and upwardly into said wet mixing chamber portion.

3. A concrete mixer as claimed in claim 1, wherein said mixing chamber includes a lower discharge chamber portion, between the wet mixing chamber portion and the discharge outlet, for directing the flow of mixture from the wet mixing chamber portion to the discharge outlet.

4. A concrete mixer as claimed in claim 1, wherein the surface of at least one of said rotatable mixing elements is provided with agitator means comprising at least one type of surface discontinuity selected from the group consisting of irregularities, apertures and projections.

5. A concrete mixer as claimed in claim 4, wherein at least one rotatable mixing element provided to effect mixing in the dry mixing chamber portion includes at least one substantially straight elongate member, projecting upwards from the upper surface of the disc.

6. A concrete mixer as claimed in claim 5, wherein an upper surface of the elongate member is inclined with respect to the upper surface of the rotatable mixing element, along the length of the elongate member.

7. A concrete mixer as claimed claim 5, wherein said elongate member includes a plurality of surfaces and at least one of said surfaces of said elongate member extends outwardly, from the centre of said rotatable mixing element, and upwardly from said upper surface of said rotatable mixing element.

8. A concrete mixer as claimed in claim 1, wherein at least one of the rotatable mixing elements is non-circular.

9. A concrete mixer as claimed in claim 1, wherein there is provided a fluid inlet to said wet mixing chamber portion, said inlet allowing fluid to enter said wet mixing chamber portion without having passed through said dry mixing chamber portion, and said inlet comprising an axial bore in said rotating shaft and a nozzle means allowing said fluid to flow out of said axial bore into said wet mixing chamber portion.

10. A concrete mixer as claimed in claim 1, wherein the housing is divided axially into a plurality of sections which may be separated from each other in order to allow access to the inside of the mixing chamber.

11. A concrete mixer as claimed in claim 10, wherein the housing comprises two sections each of which is hinged to a point fixed with respect to the mixer as a whole.

12. A concrete mixer as claimed in claim 1, wherein the mixer includes at least one material feed means to transport at least one of the materials to be mixed towards the mixing chamber.

13. A concrete mixer as claimed in claim 12, wherein the material feed means comprises a channel in which there is provided a first forcing means adapted to apply a force to material located in said channel so as to effect transportation of said material towards the mixing chamber.

14. A concrete mixer as claimed in claim 13, wherein the forcing means comprise rotatable screw or auger members.

15. A concrete mixer as claimed in claim 13 wherein said channel includes an exit aperture whereby material transported along said channel by said forcing means can exit the channel via said exit aperture, said exit aperture being located at or adjacent a downstream end of the first forcing means and said material feed means also includes a second forcing means for applying a force in substantially the opposite direction to that applied by the first forcing means, said exit aperture being positioned between the first forcing means and the second forcing means.

16. A concrete mixer as claimed in claim 12, wherein at the entrance to the materials feed means, there is provided an anti-bridging means to prevent the material from bridging across the entrance to the channel.

17. A concrete mixer as claimed in claim 16, wherein the anti-bridging means comprises at least one oscillating flap adjacent the entrance to the channel.

18. A concrete mixer as claimed in claim 12, wherein there is provided control means to control the rate of feed of at least one of the materials to be mixed.

19. A method of mixing concrete comprising the steps of:

feeding at least two substantially dry constituents of concrete, one of which is aggregate, into a mixing chamber;

causing said substantially dry constituents to be mixed together by the action of at least two rotating dry mixing members in said mixing chamber, the at least two dry mixing members being mounted upon and axially spaced from one another along a rotatable shaft and extending radially away from the axis of said shaft, said at least two rotating dry mixing members further comprising dry mixing discs; allowing said dry mixture to fall under gravity to a level in said mixing chamber below the level of said dry mixing members;

feeding a fluid constituent of concrete into said substantially dry mixture and causing said fluid to be mixed into said dry mixture, in order to form a wet mixture, by the action of a rotating wet mixing member said rotating wet mixing member being mounted upon a rotatable shaft and extending radially away from the axis of said shaft, said wet mixing member further comprising a wet mixing disc; allowing said wet mixture to fall under gravity to a level below the level of said wet mixing member so as to exit from said mixing chamber, said wet mixture exiting from said mixing chamber comprising mixed concrete.

20. A method of mixing concrete as claimed in claim 19, wherein said step of allowing said dry mixture to fall to a level below the level of said dry mixing member consists of allowing the dry mixture to pass between the dry mixing member and a wall of the mixing chamber.

21. A method of mixing concrete as claimed in claim 19, wherein said step of allowing said wet mixture to fall to a level below the wet mixing member consists of allowing the wet mixture to pass between the wet mixing member and a wall of the chamber.

22. A method of mixing concrete as claimed in claim 21, including providing a clearance between the wet mixing member and the wall of the chamber, said clearance being selected to be only slightly larger than the size of the largest pieces of aggregate of the dry concrete constituents, thereby enabling passage of the wet mixture including said aggregate through the wet mixing chamber.

23. A method of mixing concrete as claimed in claim 19, wherein the step of allowing the wet mixture to fall to below the level of the wet mixing member, and towards an exit of the mixing chamber includes inhibiting the descent of said wet mix by the provision of at least one upwardly extending projection on the inner surface of the wall of the chamber.

24. A method of mixing concrete as claimed in claim 23, including arranging the upwardly extending projection with an annular configuration which inhibits the descent of said wet mixture.

25. A method of mixing concrete as claimed in claim 19, including performing the mixing process in a constant flow manner comprising feeding the concrete constituents into the mixing chamber at such a rate that the total mass of concrete constituents fed into the mixing chamber over a given, arbitrary period of mixing is substantially equal to the mass of concrete exiting from the mixing chamber over the same period.

26. A concrete mixer comprising a housing containing a mixing chamber, the housing having an upper inlet for materials to be mixed, and a lower discharge outlet for mixed concrete, said chamber having an upper dry mixing chamber portion for the mixing of a plurality of substantially dry constituents of concrete, and a wet mixing chamber portion, lower than said dry mixing chamber portion, for the mixing of at least one fluid with the mixture of substantially dry constituents of concrete and said mixer including in said mixing chamber at least one rotatable mixing element positioned in the path between said inlet and said discharge outlet to effect mixing of the materials to be mixed, wherein there is provided a fluid inlet to said wet mixing chamber portion, said inlet allowing fluid to enter said wet mixing chamber portion without having passed through said dry mixing chamber portion, and said inlet comprising an axial bore in said rotating shaft and a nozzle means allowing said fluid to flow out of said axial bore into said wet mixing chamber portion.

27. A concrete mixer comprising a housing containing a mixing chamber, the housing having an upper inlet for materials to be mixed, and a lower discharge outlet for mixed concrete, said chamber having an upper dry mixing chamber portion for the mixing of a plurality of substantially dry constituents of concrete, and a wet mixing chamber portion, lower than said dry mixing chamber portion, for the mixing of at least one fluid with the mixture of substantially dry constituents of concrete and said mixer including in said mixing chamber at least one rotatable mixing element positioned in the path between said inlet and said discharge outlet to effect mixing of the materials to be mixed, wherein a wall of said wet mixing chamber portion comprises an inclined surface extending downwardly and inwardly towards said rotatable shaft, defining an exit aperture of said wet mixing chamber portion located below said wet mixing disc, and having an annular projection extending around said exit aperture and projecting inwardly and upwardly into said wet mixing chamber portion.

* * * * *